United States Patent [19]

Sustarsic et al.

[11] 3,984,289

[45] Oct. 5, 1976

[54] COKE QUENCHER CAR APPARATUS

[75] Inventors: John D. Sustarsic, McKees Rocks; Ronald O. McClelland, Pittsburgh, both of Pa.

[73] Assignee: Koppers Company, Inc., Pittsburgh, Pa.

[22] Filed: May 14, 1975

[21] Appl. No.: 577,615

Related U.S. Application Data

[63] Continuation-in-part of Ser. No. 488,163, July 12, 1974, abandoned.

[52] U.S. Cl. ..... 202/262; 202/227; 202/229; 55/385 R; 55/356; 201/39; 202/263; 105/377

[51] Int. Cl.[2] ..... C10B 39/14

[58] Field of Search ..... 202/262, 263, 227, 229, 202/228; 105/377; 55/385, 237, 388, 356; 201/39

[56] References Cited

UNITED STATES PATENTS 3,843,461 10/1974 Allen ..... 202/263 X 3,868,309 2/1975 Sustarsic et al. ..... 202/263 X

FOREIGN PATENTS OR APPLICATIONS 892,832 3/1962 United Kingdom

*Primary Examiner*—James H. Tayman, Jr.

*Attorney, Agent, or Firm*—Sherman H. Barber; Oscar B. Brumback

[57] ABSTRACT

A coke quencher car apparatus comprises a receptacle that is similar to a standard quencher car, but having one internal baffle forming coke compartments, and a frame at each end thereof on which is supported metal curtain material. Each curtain is stretchable to cover one of the coke compartments during and after the pushing of coke is completed. The quencher car is connected to a traction car carrying equipment to remove and clean gases arising from the pushed coke in the quencher car and to move the quenching car.

13 Claims, 13 Drawing Figures

COKE QUENCHER CAR APPARATUS

CROSS REFERENCE TO RELATED APPLICATION

This application is a continuation-in-part of application Ser. No. 488,163 filed July 12, 1974, and now abandoned.

BRIEF SUMMARY OF THE INVENTION

A receptacle mounted on a frame of a quencher car that is movable along the coke side of a coke battery has an open top and a flexible screen arranged on each end of the receptacle. The screens are stretchable and retractable over the receptacle to cover hot coke therein. Means for moving the quencher car along the battery is provided and it carries equipment that removes and cleans gases arising from hot coke pushed into the receptacle portion of the quencher car.

In a modification of the invention, the screens are supported on powered reels journaled at each end of the receptacle.

For a further understanding of the invention and for features and advantages thereof, reference may be made to the following description and the drawing which illustrates a preferred embodiment and modifications of equipment in accordance with the invention.

DETAILED DESCRIPTION

Figure 1:
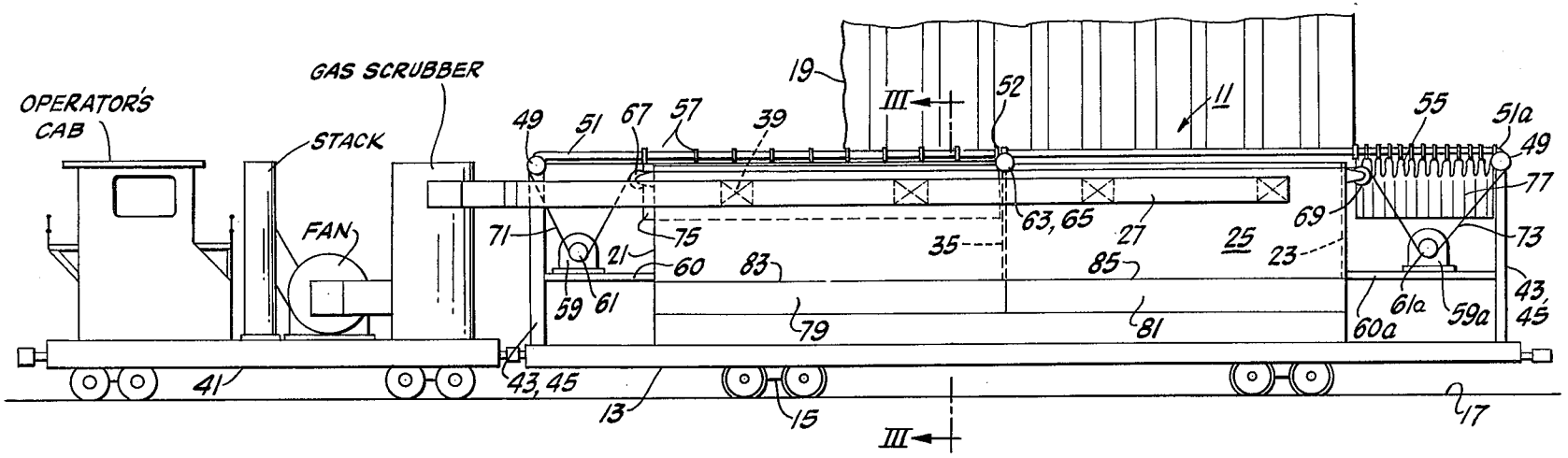
FIG. 1 is a schematic elevational view of a quencher car apparatus in accordance with the present invention.
Figure 4:
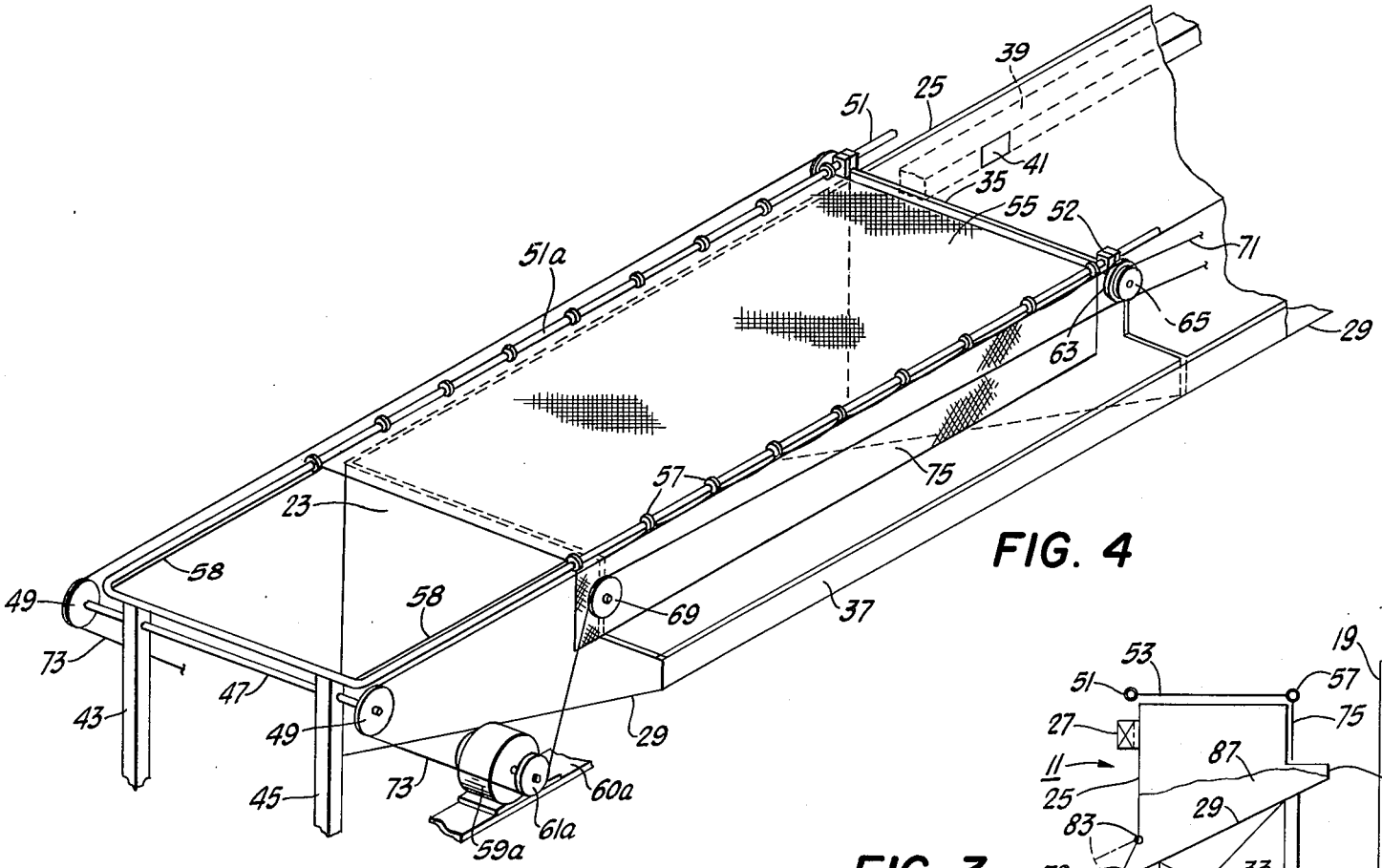
FIG. 4 is a schematic perspective view of a portion of the apparatus of FIGS. 1 and 2.

Referring to FIG. 1, a quencher car 11 in accordance with the invention comprises a frame 13 supported on conventional trucks 15 that coact with rails 17 located alongside a coke oven battery 19.

The quencher car 11 carries on the frame 13 a rectangular shaped container or receptacle for hot coke having end walls 21, 23; an elongate side wall 27; and a sloping bottom 29. The entire rectangular compartment or receptacle is supported by columns 31 and cross bracing 33 on the frame 13, as suggested in FIG. 3.

Within the rectangular container or receptacle there is one transverse baffle 35 tht subdivides the interior of the receptacle into two separate coke compartments.

Figure 3:
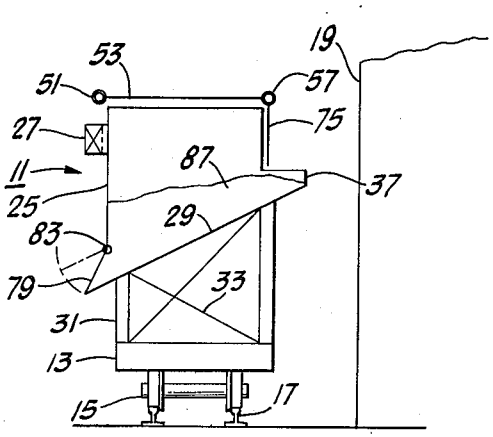
FIG. 3 is a view along line III—III of FIG. 2.

The sloping bottom 29 extends outside of the columnar supports 31 on both sides, as shown in FIG. 3, and on the side of the quencher car adjacent the coke oven battery 19, there is a vertical plate 37 that connects to and extends the length of the bottom 29.

The vertical side wall 25 carries an elongate duct 27 that communicates with the coke compartments through several openings 39 in the side wall 25 of each compartment. The duct 27 is closed at the right-hand end, as viewed in FIG. 1, and the duct extends toward the left beyond the frame 13 and connects to a gas scrubber situated on another car 41 described hereinafter.

The frame 13 of the quencher car 11 extends beyond the end walls 21, 23 a sufficient distance to support a pair of stanchions 43, 45 at each end of the car 11. These stanchions 43, 45 carry a transversely extending shaft 47 on the ends of which are mounted sheaves 49. The end portion of U-shaped pipe frames 51, 51*a* extend along the sides of the receptacle and the frames 51, 51*a* connect to a support 52 a the mid-length point of the receptacle.

The pipe frame carries two separate sections of flexible metal curtains 53, 55 that are supported on the pipe frame at spaced intervals by loops or rings 57 that are secured suitably to the metal curtains 53, 55 and that slide along the pipe frames 51, 51*a*. The loops or rings 57 nearest the looped-end of the pipe frames 51, 51*a* are connected to the looped-end by a length of wire rope 58 or the like. One type of metal curtain material which has been found to be satisfactory is that made and sold by Audubon Metalwove Belt Corp. of Philadelphia, PA., though curtain material manufactured by others may be found to be suitable. A feature of such metal curtain material is that it is flexible in one direction, lengthwise of the receptacle, but is practically inflexible in the other direction, transversely of the receptacle.

Figure 2:
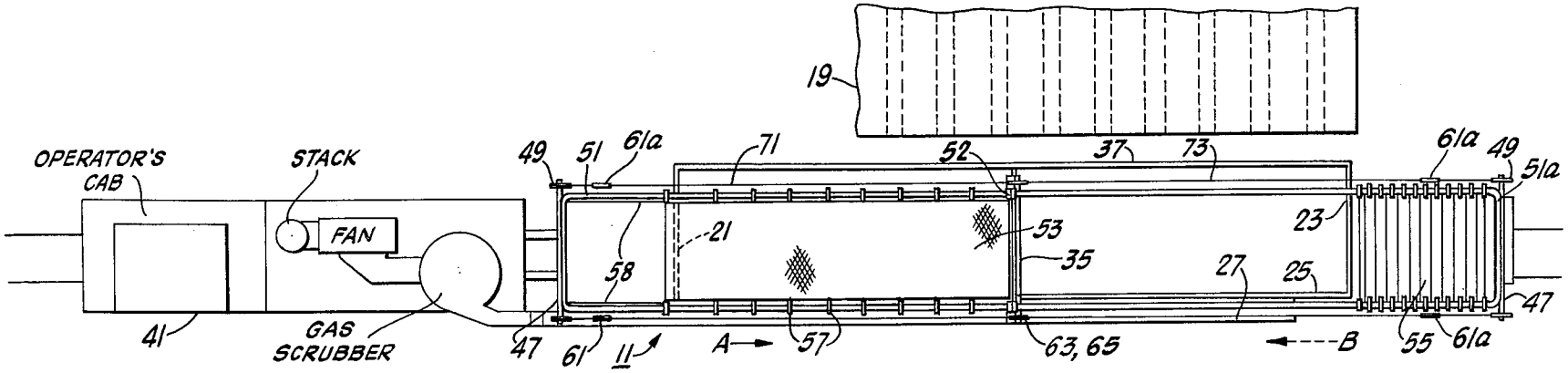
FIG. 2 is a schematic plan view of the apparatus of FIG. 1.

There is provided at both ends of the frame 13 and on both sides thereof, as shown in FIG. 2, suitable rotary elements 59, 59*a*. Each such rotary element 59, 59*a* carries a sheave 61, 61*a*, and the rotary elements 59, 59*a* are mounted on suitable supporting platforms 60, 60*a*.

At the mid-length position of the car 11, there are mounted to the center baffle 35 a pair of sheaves 63, 65 on each side of the car, and at the end walls 21, 23 there is mounted a single sheave 67, 69 on each side of the car 11.

A wire cable or rope 71 is connected to the loop or ring 57 at the end of the metal curtain 53 and passes around sheaves 49, 61, 67, 63 and connects again to the loop or ring 57 in endles fashion. In like manner, at the other end of the car 11, another wire cable or rope 73 is connected to the loop or ring 57 at the end of the metal curtain 55 and passes around sheaves 49, 61*a*, 69 and 65, on both sides and is connected to the same loop or ring at the end of the metal curtain 55 in endless fashion.

Thus, when the rotary element 59 is activated, the wire cable or rope 71 moves in the direction of the arrow A (FIG. 1) and the metal curtain 53 is withdrawn from its stowed or folded position, at the left-hand end of the car 11, and is stretched to cover the left-hand coke compartment of the car 11, as shown in the drawing, the wire rope 58 limiting the travel of the metal curtain toward the right.

It will be noted from FIG. 2 that the metal curtain 55, at the right-hand end of the car 11, is in the stowed or folded position, wherefrom it can be withdrawn and stretched over the right-hand compartment of the receptacle by activating the rotary element 59*a*.

The loops or rings 57 on the pipe frame portion nearer the coke oven battery 19 also carry vertical side portions of similar metal curtain material 75, 77 which can be stretched to a flat attitude as shown at the left-hand side of FIG. 1, from a stowed or folded position, as shown at the right-hand side of FIG. 1. The vertical side portions 75, 77 move concurrently with the top portions 53, 55 when the rotary elements 59, 59*a* are activated. The wire rope 58 also limiting the travel of the side wall 75 toward the right.

From FIGS. 1 and 3 it will be observed that two lower portions 79, 81 of the side wall 25 are hinged, as at 83, 85, and each hinged portion 79 and 81 is operable by mechanism (not shown) to dump hot coke 87 from the coke compartments of the car 11. The two lower portions 79, 81 may be opened singly or together, as the case may be.

The other car 41 is a traction car or locomotive on which is situated, besides the gas scrubber already mentioned herein, a fan, a stack and a locomotive operator's cab wherein there are controls for activating car 41 and the equipment on the cars 11, 41.

Figure 5:
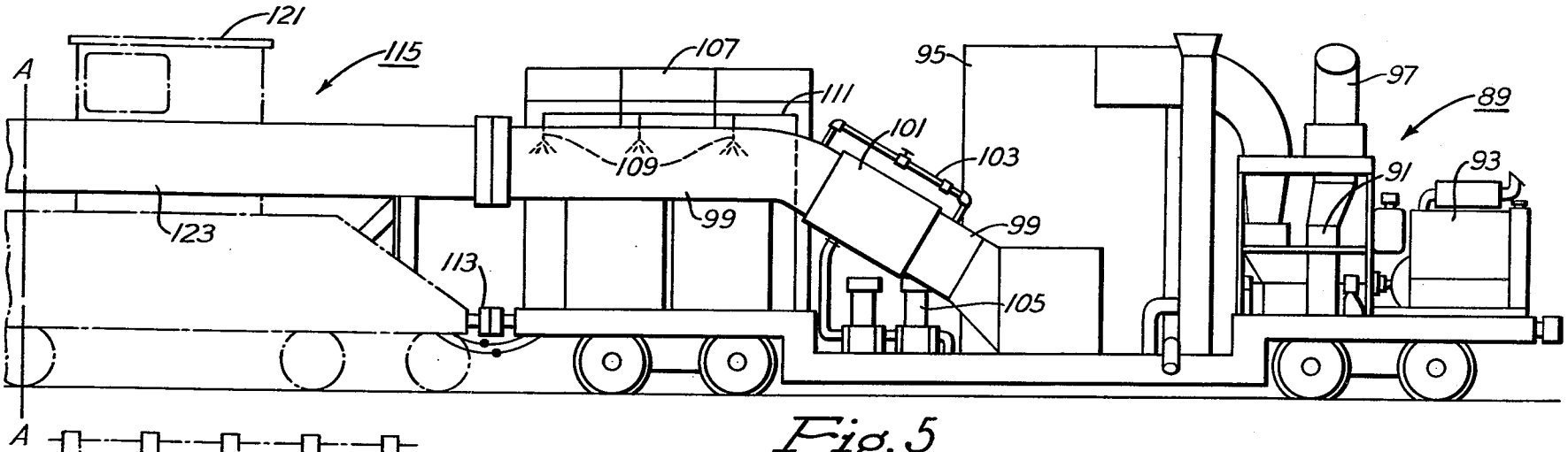
FIGS. 5 and 5*a* illustrate schematically an elevational view of another form of quencher car in accordance with the invention.
Figure 5A:
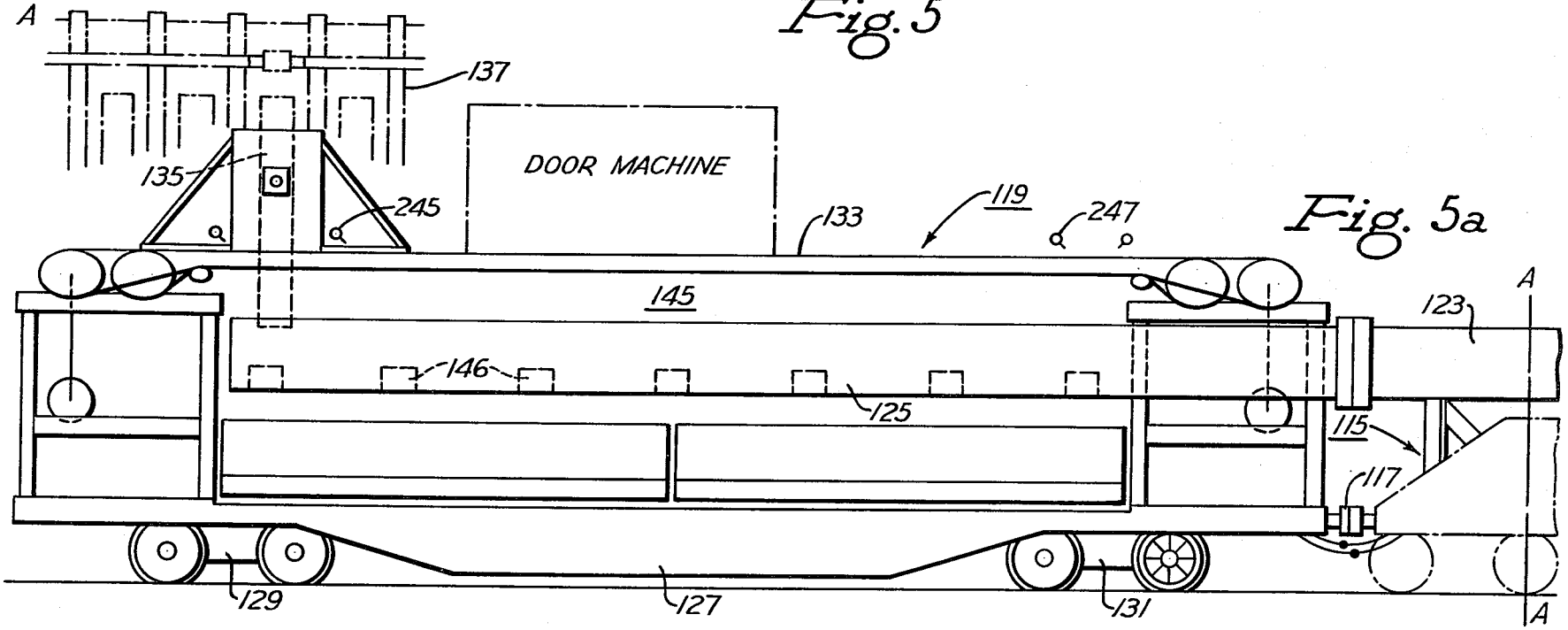

FIGS. 5 and 5*a* illustrate another embodiment of the present invention; the respective FIGS. 5 and 5*a* matching along line A—A in both figures.

At the right-hand end of FIG. 5 there is shown a gas cleaning car 89 which includes a fan 91 that is powered by a Diesel engine 93, the fan drawing gases from a cyclone separator 95. The clean gases withdrawn by the fan 91 are discharged to atmosphere through a stack 97 located about where shown.

Gases enter the bottom of the cyclone separator 95 through a conduit 99 in which there is a wet Venturi scrubber 101. The water used in the wet Venturi scrubber being supplied to sprays (not shown) connected to a spray header 103. Pumps 105 deliver the water to the spray header 103 from a storage tank (not shown) on the car 89.

At the left-hand end of the gas cleaning car 89 there is an electrical control panel 107, and in the conduit 99 there is shown a plurality of gas cooling sprays 109. Water for the sprays 109 is supplied by a spray header 111 and the pumps 105.

The gas cleaning car 89 is coupled, as at 113, to one end of a traction car or locomotive 115 that is coupled at the other end, as at 117, to one end of a modified coke quencher car 119. The locomotive 115 includes an operator's cab 121 which is similar to the operator's cab of FIG. 1. Also, the locomotive 115 carries a length of conduit 123 that is coupled at one end to the conduit 99 and at the other end to a conduit 125 carried on the quencher car 119.

The quencher car 119 has a frame 127 that is carried by conventional front and rear (left and rear, as shown in FIG. 5*a*) wheel and axle trucks 129, 131. The frame 127 carries a rectangular-shaped open-topped receptacle 133 into which falls hot coke pushed from a coke oven chamber 135 of a coke oven battery 137.

Figure 12:
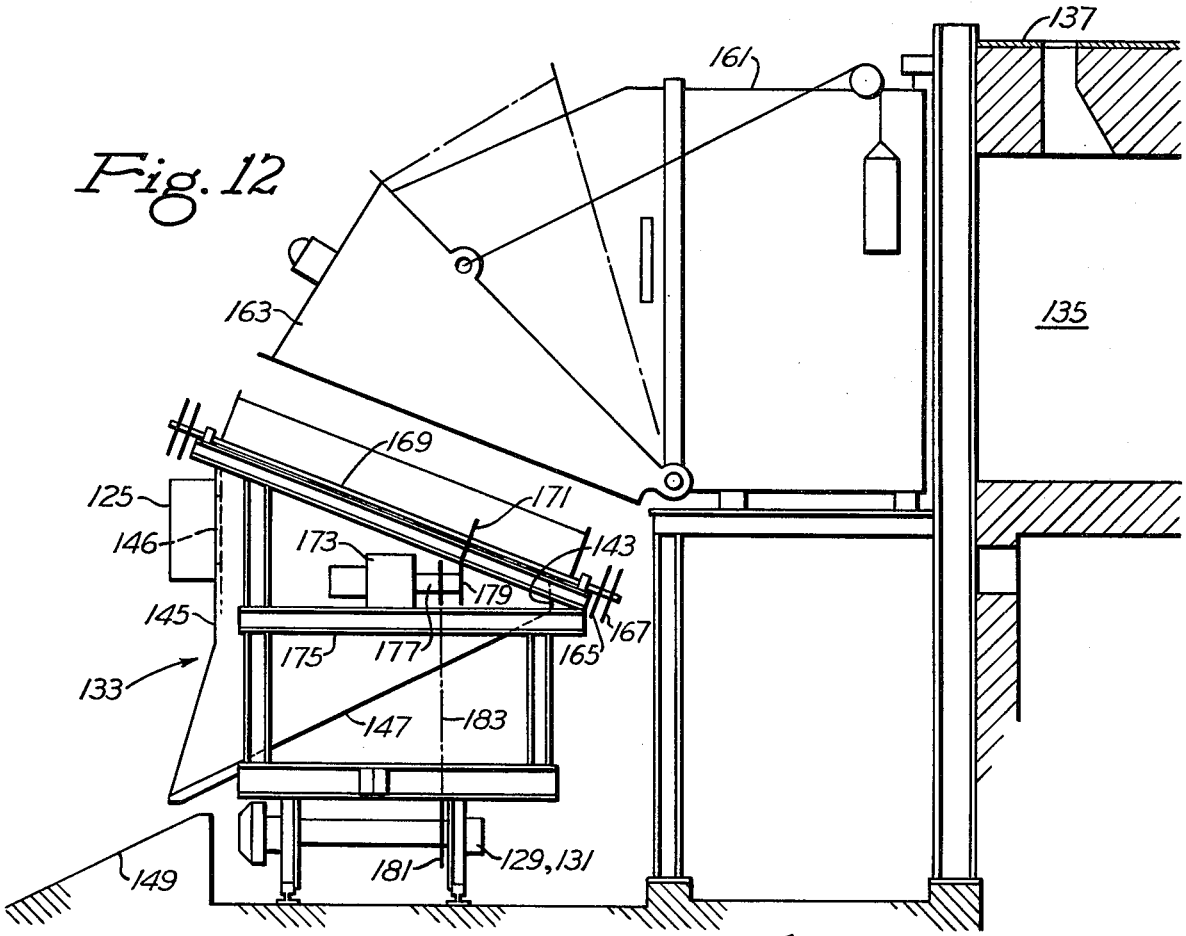
FIG. 12 is a view of one end of a quencher car in accordance with the invention in operative position at a coke oven battery.

The receptacle 133 has two end walls 139, 141 and two long side walls 143, 145. The long side wall 145 is higher than the opposite long side wall 143 as may be seen in FIG. 12. The long side wall 145 is provided with a plurality of rectangular-shaped ports or openings 146 through which gases arising from hot coke falling into the receptacle flow into the conduit 125; the left-hand end of the conduit 125, as viewed in FIG. 5*a*, being sealed. Referring to FIG. 12, it is seen that the long side wall 145 is considerably higher than the long side wall 143. Thus, the plane of the open top of the receptacle 133 is slanted downwardly toward the botton of the coke oven battery 137.

As shown in FIG. 12, the receptacle 133 has a planar bottom 147 like the bottom 29 shown in FIG. 3; the bottom 147 sloping downwardly away from the coke oven battery 137 toward a conventional coke wharf 149.

Figure 6:
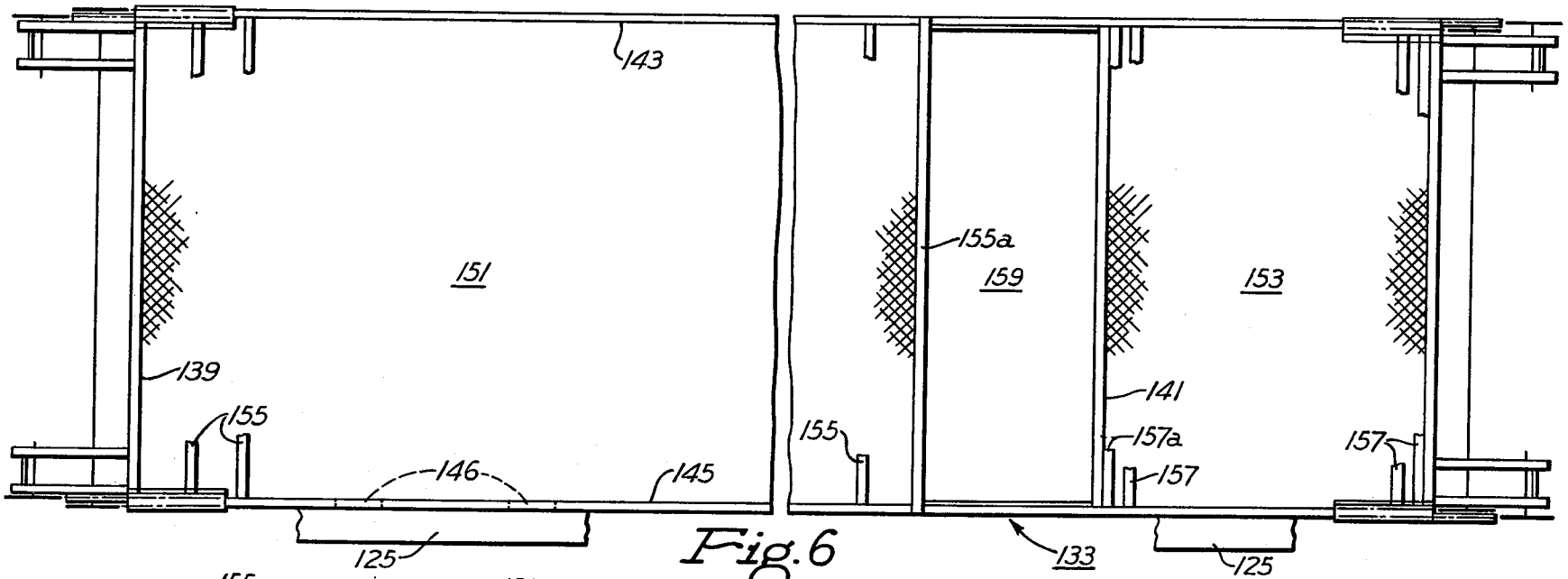
FIG. 6 is a plan view of the top of the apparatus of FIG. 5*a;*
Figure 7:
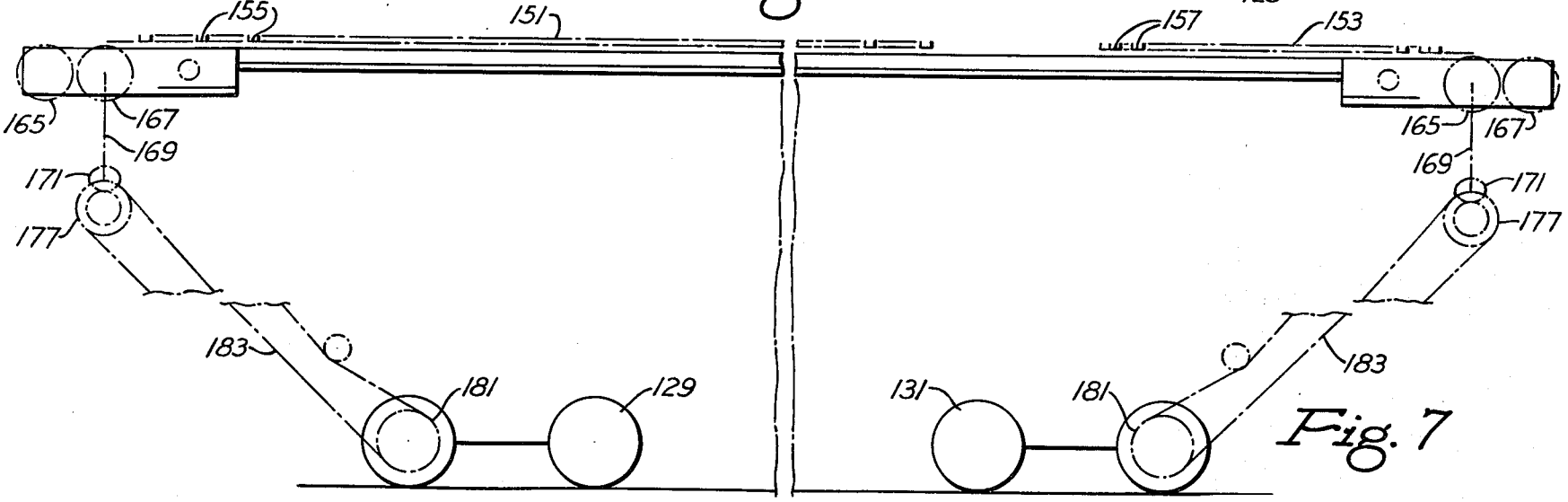
FIG. 7 is a schematic view of the power system for moving the screens of FIG. 6.

The apparatus shown in FIG. 6 is a plan view of a left-hand screen or curtain 151 and a right-hand screen or curtain 153 that both cover the slanted open top of the receptacle 133. The left-hand screen 151 is similar to the screen or curtain 53 of FIG. 2 and the right-hand screen 153 is similar to the screen or curtain 55 of FIG. 2. While not shown as such in FIG. 6, the right-hand screen 153 is folded in loops like the right-hand screen 55 of FIG. 2. In like manner, the left-hand screen, when retracted as described hereafter, also folds, as does the screen or curtain 53 of FIG. 2 in the space to the left of end wall 139 of FIG. 6. The respective screens 151, 153 are each provided with a plurality of spaced-apart stiffeners 155, 157 that extend transversely of the receptacle 133 and that are supported on the top surface of the long side walls 143, 145 by rollers (not shown). Each right- and left-hand curtain being provided with an end stiffener or screen drawbar 155*a*, 157*a*.

Between the screen drawbars 155*a* and 157*a* is an opening 159 extending transversely the full width of the receptacle 133. This opneing 159 is the opening through which hot coke enters the quencher car from a coke guide 161 and hood 163 arrangement, like that shown in FIG. 12 or any other suitable arrangement of coke guide and hood apparatus.

The screens 151, 153 are each connected to a system of draw chains that cooperate with driven sprockets 165, 167 at each end of the receptacle 133. The sprockets 167 are mounted to a shaft 169 (FIG. 12) that is provided with a sprocket 171 where shown. An electric motor and a clutch coupling assembly 173 is mounted to a suitable support 175 at each end of the structural supports for the receptacle, and a sprocket and clutch assembly 177 is mounted adjacent the motor-clutch assembly 175. The sprocket and clutch assembly 177 carries on the end of a shaft a bevel gear 179 that cooperates with the sprocket 171.

As shown in FIG. 12, one of the axle-wheel assemblies 129, 131 at the end of the quencher car 119 carries a sprocket 181 around which a chain 183 is looped that also is looped around the sprocket 177 in a driving relation thereto.

The quencher car 119 of FIG. 6 is shown in position after the receptacle thereof has been filled with hot coke. The opening 159 is shown as a minimum opening to accommodate the fume hood 163.

As the quencher car 119 moves along in front of the chamber 135 being pushed, the chain drive assembly originating with the sprocket 181, turning with the wheel-axle assemblies 129, 131, drives the sprockets 165, 167 so that screens 151 and 153 move simultaneously across the sloping top of the receptacle 133 and keep it closed as hot coke gravitates into the receptacle.

When the quencher car 119 reaches the coke quenching station and is stationary there, the operator in the operator's cab can press a switch button on a control console to engage the motor-clutch 173 with the sprocket clutch 177. The motor then provides power to open the screens 151, 153 to admit the quenching fluid to the hot coke. After quenching, the operator closes the screens 151, 153 before the quencher car stops at the coke wharf to discharge the quenched coke. The car then returns to the battery and is spotted at the next oven to be pushed.

FIGS. 8–11 illustrate another form of apparatus for accommodating the screens when they are withdrawn from covering the open top of the quenching car 119.

At each end of the quencher car 119 there is positioned a cylindrical reel or drum 185, 187 which is suitably journaled, as at 189, to quencher car structure 191. Each reel or drum 185, 187 is driven by a chain 193 looped around a sprocket 195 on the drum shaft 197 and around a sprocket 199 of a power train 201.

Figure 9:
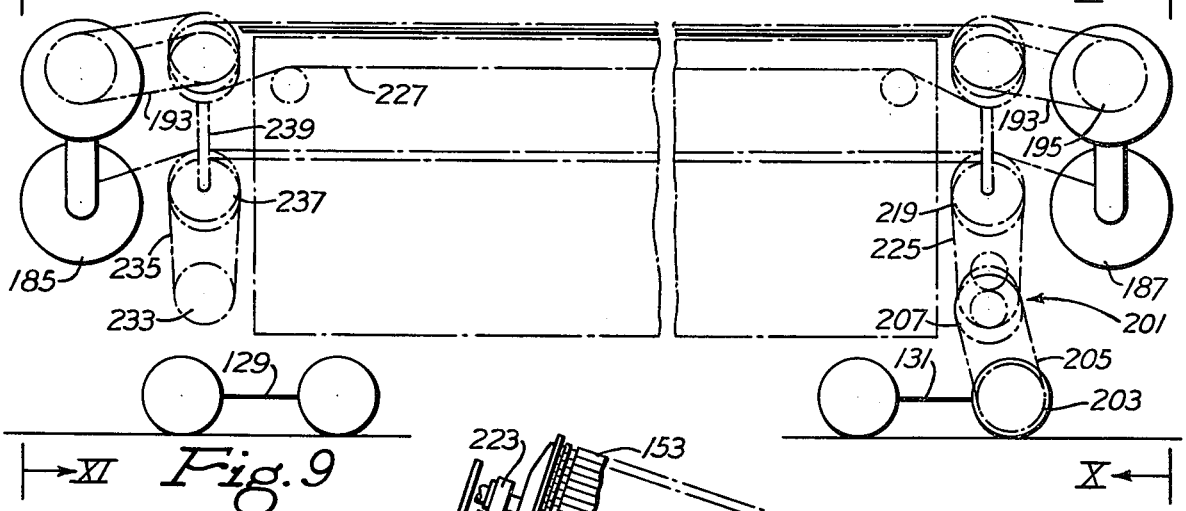
FIG. 9 is a schematic view of the power system for moving the screens of FIG. 8.
Figure 10:
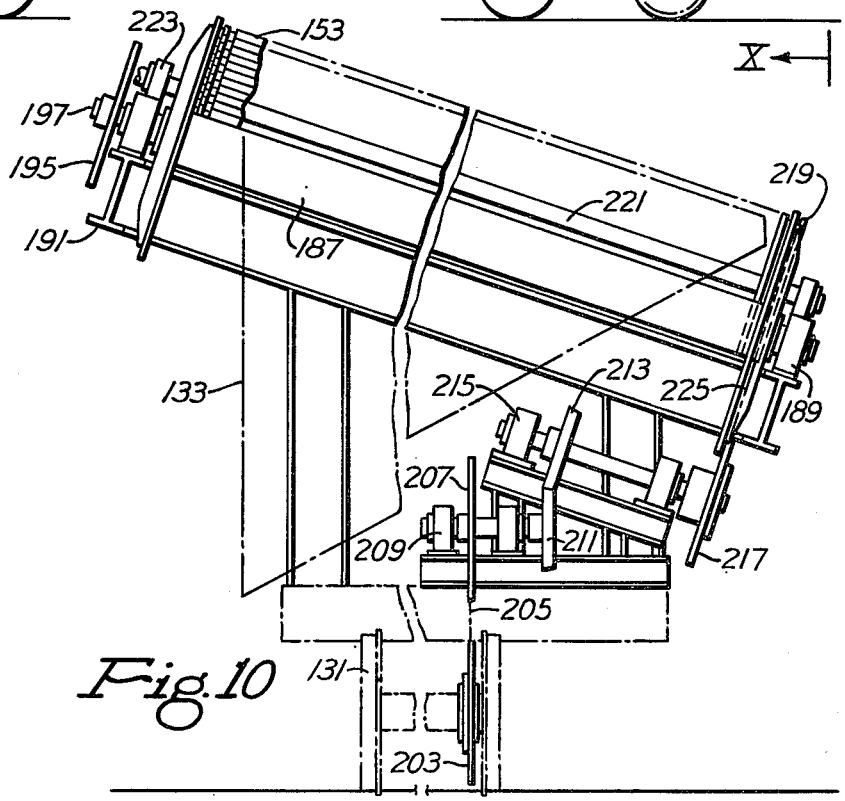
FIG. 10 is a view along line X—X of FIG. 9 and showing details not illustrated in FIG. 9.

In FIG. 9, the power train 201 is shown in schematic form, but in FIG. 10 the power train 201 is shown as comprised of a sprocket 203 mounted to the wheel-axle assembly 131 (only one wheel-axle assembly is active in this embodiment of the invention) and a drive chain 205 that loops around it and another sprocket 207 of a jack-shaft assembly 209 mounted about where shown in FIG. 10. The jack-shaft assembly 209 includes a bevel gear 211 that coacts with a bevel gear 213 mounted to an automatic drive assembly 215 about as shown in FIG. 10. The automatic drive assembly includes a sprocket-clutch assembly 217 that is connected to a curtain drive sprocket 219 mounted to a curtain drive shaft 221 suitably journaled as at 223 by a chain 225. Draw chains 227 for moving the screens 151, 153 are shown also in FIG. 9.

In FIG. 10, the right-hand screen 153 is shown in the rolled-up position on the drum 187.

Figure 8:
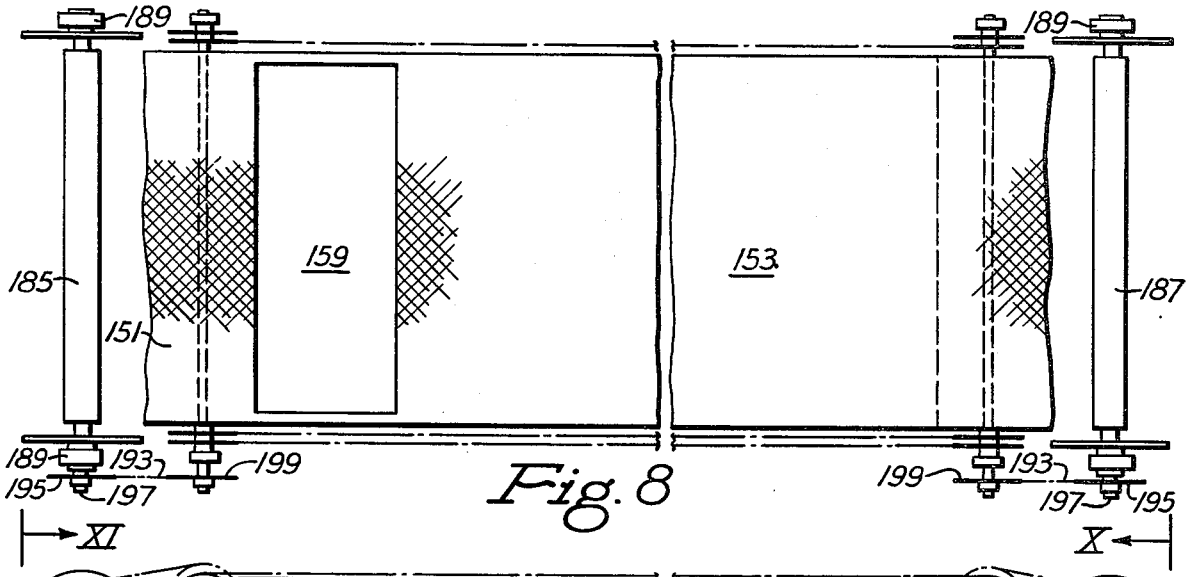
FIG. 8 is a schematic plan view of the top of a modification of the apparatus of FIG. 5*a;*
Figure 11:
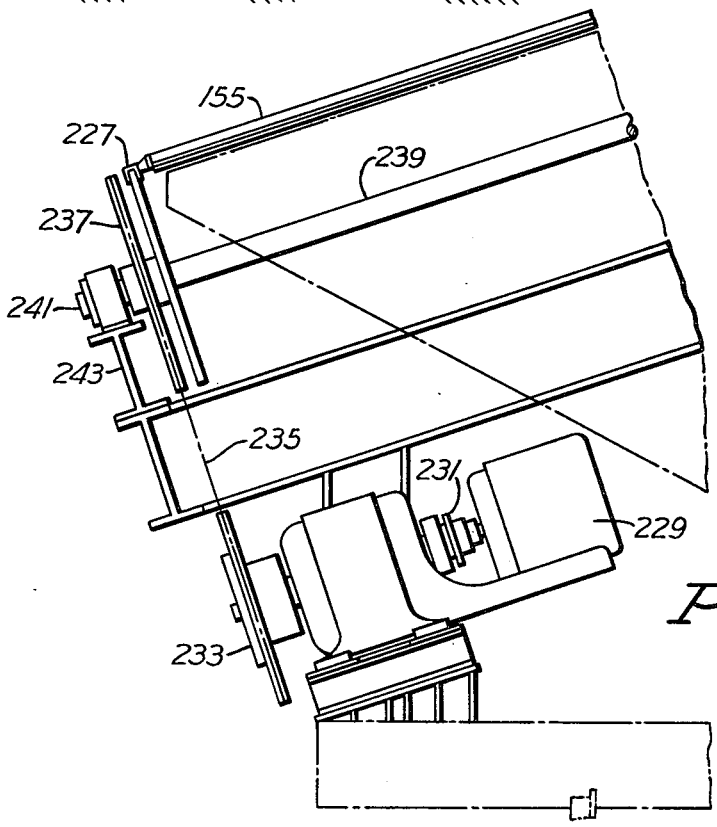
FIG. 11 is a view along line XI—XI of FIG. 9 and showing details not illustrated in FIG. 9.

FIG. 11 illustrates the motor drive for the screen 151, located at the left-hand end of the quencher car shown in FIGS. 8 and 9. The motor drive includes an electric motor 229 with a torque coupling 231 that is engaged to a sprocket-clutch 233, the sprocket portion carrying a drive chain 235 that loops around a drive sprocket 237 on a drive shaft 239 of the screen 151 journaled as at 241 to suitable structure 243. The chains 227 that move the screen and the transverse support bars 155 for the screen are also shown in FIG. 11.

In operation, the quencher car 11 is positioned at an oven chamber to be pushed in such a way that the coke passing through a coke guide 161 and hood 163 falls initially into the first compartment at the right-hand end of the quencher car 11, as viewed in FIG. 2; the metal curtain 55 at the right-hand end, being initially in the stowed or folded position as shown, and the metal curtain 53 at the left being extended covering the left half of the quencher car. As the coke falls into the quencher car, it is moved by the traction car or locomotive toward the right, as viewed in FIG. 2. At the same time, the rotary elements **59*a* on both sides of the receptacle are activated to commence stretching the metal curtain 55 on the right-hand side over the coke in the compartment of the right-hand half of the receptacle and retracting the metal curtain 53** on the left side.

When pushing is completed, the left-hand metal wove curtain closes over the left-hand coke compartment, and the coke guide moves to the next oven to be pushed. Then, the quencher car is ready to be moved to the quenching station or other location.

During the pushing sequence and during the time the car is travelling to the quenching station, the equipment on the traction car is operating to remove and scrub the gases arising from the hot coke.

Considering the embodiment of the invention shown in FIGS. 5–12, it will be understood by those skilled in the art that the right- and left-hand screens may be stowed in either a folded arrangement or on the reels. In either case, the screens are moved simultaneously with the quencher car by means of a power train using the axle of one or both trucks as a source of power. This is the source of power when the coke is being pushed. After the hood has been raised and the coke guide and hood are moved to the next oven to be pushed, the opening between the screens is closed by moving one screen relative to the other. At the coke quenching station, when the quencher car is stationary and the normal power train is not available, the screens are moved to their respective stowed positions by means of the motorized automatic power train under the control of the operator in the locomotive.

As in the embodiment of the invention shown in FIGS. 1–4 and described herein, the equipment on the gas cleaning car is operative to induce suction in the conduit extending along the higher side wall of the quencher car shown in FIGS. 5–12 so that effluent from the hot coke falling into and residing in the quencher car is continually removed and cleaned.

In FIG. **5*a*, conventional limit switches 245 and 247** are provided at the opposite ends of the receptacle. These limit switches prevent overtravel of the screens or curtains when they are operated under control of the operator in the locomotive.

Now, referring to FIG. **5*a*, the quencher car 119 is shown in position so that coke being pushed from oven chamber 135 will fall into the car as it travels toward the left, as viewed in FIG. 5*a*.** The locomotive operator adjusts the screens or curtains by means of switches that control the motors on the ends of the car. The screen or curtain at the left-hand end of the quencher car is in the folded position or is wound around the left-hand reel or drum. The screen or curtain at the right is extended over the open top of the receptacle to a position that allows enough space between the screens for the coke hood. After the hood is lowered into position, the push can commence.

As the coke is being pushed from the oven, the screens or curtains are automatically controlled. That is to say, the left-hand screen or curtain unfolds are unwinds from the reel or drum, and the right-hand screen or curtain (as viewed in FIG. **5*a*)** folds into the stowage space at the right-hand end of the car, or it is wound up on the reel or drum.

After the car is loaded and the fume hood is raised, the opening is closed by extending the right-hand screen or curtain to meet the left-hand screen or curtain under the control of the operator in the locomotive. With the car completely covered by the screens or curtains, it is then moved to the quenching station. Both screens or curtains are retracted to the folded or rolled-up positions; the coke is quenched; and the car is moved to the coke wharf where the coke is unloaded. The car then is moved to the next oven to be pushed and the cycle is repeated.

As described herein, there is a screen or curtain drive mechanism at each end of the car that moves the respective right- and left-hand screens or curtains.

The drive mechanism is powered either (1) by a chain drive from an axle of the car, or (2) by an electric motor and gear reducer and bevel gears.

Those skilled in the art will understand that conventional controls will be interlocked to permit the operation of the hood and of the screens or curtains to follow a preselected sequence.

From the foregoing description of embodiments of the invention, those skilled in the art should recognize many important features and advantages of it, among which the following are particularly significant:

That the apparatus of the invention is both effective and efficient in containing, removing and cleaning gases arising from hot coke as it is being pushed into the coke quencher car and as the car is being moved to the quencher station;

That the apparatus of the invention is readily adaptable to existing coke oven batteries as it is to newly constructed batteries; and That the apparatus of the invention can be made so that operation is automatic, requiring minimum attention by operating personnel.

Although the invention has been described herein with a certain degree of particularly it is understood that the present disclosure has been made only as an example and that the scope of the invention is defined by what is hereinafter claimed.

What is claimed is:

1. Apparatus that receives and transports hot coke pushed from a chamber of coke oven battery comprising:

a. a receptacle mounted on a frame that is movable along the coke side of said battery and that receives coke pushed from said chamber of said battery, said receptacle having an open top and an open side portion that is adjacent said coke oven battery chamber;

b. a first flexible screen that is fixed at one end to one end of said receptacle and that is retractable and stretchable over said open top thereof;

c. a second flexible screen that is fixed at one end to one end of said receptacle and that is retractable and stretchable over said open side portion thereof;

d. means for stretching and retracting said first screen;

e. means for stretching and retracting said second screen; and f. means for moving said receptacle along said battery, said means carrying equipment that removes, cleans and exhausts gases arising from said coke in said receptacle.

2. The invention of claim 1 including:

a. means for stretching and retracting each portion of flexible screen.

3. The invention of claim 1 including:

a. means on said receptacle for stowing each screen portion.

4. Apparatus that receives and transports hot coke pushed from a chamber of a coke oven battery comprising:

a. a receptacle that is mounted on a frame that is movable along the coke side of said battery and that receives said coke, said receptacle having an open top and an open side portion that is adjacent said coke oven battery chamber;

b. a first flexible screen that is fixed at one end of said receptacle and that is retractable and stretchable over said open top thereof;

c. a second flexible screen that is fixed at one end of said receptacle and that is retractable and stretchable over said open side portion thereof;

d. means for stretching and retracting said first flexible screen;

e. means for stretching and retracting said second flexible screen;

f. means on said receptacle for stowing said first flexible screen when retracted;

g. means on said receptacle for stowing said second flexible screen when retracted; and h. a traction car connected to said frame and carrying equipment that removes, cleans and exhausts gases arising from coke within said receptacle.

5. The invention of claim 4 including:

a. means for stretching and retracting each portion of flexible screen; and b. means on said receptacle for stowing each portion of said flexible screen when it is retracted from covering its portion of said receptacle.

6. The invention of claim 4 including:

a. means for discharging said coke from said receptacle.

7. The invention of claim 4 including:

a. means within said receptacle that subdivide the interior thereof into coke receiving compartments; and b. means for discharging said coke from one or more compartments of said receptacle.

8. Apparatus that receives and transports hot coke pushed from a chamber of a coke oven battery comprising:

a. a receptacle mounted on a frame carried by wheel-axle trucks engaging rails, that is movable along the coke side of said battery and that receives said hot coke, said receptacle having an open top that slops downwardly toward said battery;

b. a pair of flexible screens or curtains arranged on stowage reels journaled to said frame, said screens or curtains being adapted to cover said open top of said receptacle;

c. means for stretching said screens or curtains over said open top and for retracting said screens or curtains onto said stowage reels;

d. means for moving said receptacle along said battery as hot coke is pushed from said chamber and is received in said receptacle; and e. a conduit mounted to one side of said receptacle having one or more openings communicating with said conduit whereby effluent arising from said hot coke in said receptacle passes into said conduit.

9. The invention of claim 8 wherein:

a. said means for stretching and retracting said screens or curtains includes:

i. a chain drive system connecting each stowage reel with one axle of each truck, and ii. means for disconnecting said chain drive system, and iii. means for rotating said reels independently of said chain drive system.

10. The invention of claim 8 wherein:

a. said means for stretching and retracting each one of said screens or curtains includes:

i. a chain coacting with a sprocket on an axle and a sprocket on a shaft carrying one bevel gear that coacts with another bevel gear carried by said reel carrying said screen or curtain.

11. Apparatus that receives and transports hot coke pushed from a coke oven battery chamber comprising:

a. an open-topped receptacle mounted on a frame that is carried by wheel-axle trucks engaging rails, and that is movable along the coke side of said battery and that receives said hot coke;

b. a pair of flexible screens or curtains mounted to reels journaled to said frame near the ends of said receptacle on which said screens or curtains are stowed when retracted from covering said open-topped receptacle;

c. a locomotive connected to said frame that moves said apparatus on said rails along said coke oven battery;

d. a conduit on said receptacle that collects and conveys effluent arising from said hot coke as it falls into and remains within said receptacle;

e. means carried by a car on said rails that is movable by said locomotive for receiving and cleaning said effluent; and f. drive means connecting said axle with said reel for rotating said reel and thereby extending and retracting each screen or curtain as said apparatus moves along said battery.

12. The invention of claim 11 wherein:

a. said drive means includes:

i. a sprocket on said axle, ii. a sprocket on said reel, and iii. a chain coacting with each sprocket.

13. The invention of claim 11 wherein:

a. said drive means includes:

i. a sprocket on said axle, ii. a sprocket on said reel, and iii. a chain cooperating with said sprockets as the means for rotating said reel as said axle turns.

* * * * *